US006029714A

United States Patent [19]

Imamura et al.

[11] Patent Number: 6,029,714

[45] Date of Patent: Feb. 29, 2000

[54] STAINLESS STEEL PIPE OF BRIGHT ANNEALING FINISH TYPE, HAVING HIGHLY-SMOOTHED INNER SURFACE AND METHOD FOR PRODUCING THE SAME

[75] Inventors: Yoichi Imamura; Munekatsu Furugen, both of Osaka; Hajimu Choba, Fujisawa, all of Japan

[73] Assignees: Sumitomo Metal Industries, Ltd., Osaka; Sumikin Stainless Steel Tube Co., Ltd., Sashima, both of Japan

[21] Appl. No.: 08/727,390

[22] PCT Filed: Apr. 13, 1995

[86] PCT No.: PCT/JP95/00725

§ 371 Date: Oct. 10, 1996

§ 102(e) Date: Oct. 10, 1996

[87] PCT Pub. No.: WO95/28239

PCT Pub. Date: Oct. 26, 1995

[30] Foreign Application Priority Data

Apr. 14, 1994 [JP] Japan ..... 6-075788

[51] Int. Cl.[7] ..... F16L 9/02

[52] U.S. Cl. ..... 138/177; 138/178; 138/DIG. 11; 29/432.1

[58] Field of Search ..... 138/177, 178, 138/DIG. 11; 29/432.1, 508

[56] References Cited

U.S. PATENT DOCUMENTS

| | | | |
|---|---|---|---|
| 2,503,512 | 4/1950 | Sattele et al. | 138/177 |
| 2,679,681 | 6/1954 | Resler | 138/109 |
| 3,678,727 | 7/1972 | Jackson | 72/367 |
| 3,820,230 | 6/1974 | Katunich et al. | 138/109 |
| 4,346,739 | 8/1982 | Asada | 138/177 |
| 4,967,462 | 11/1990 | Murakami | 29/432.1 |
| 5,106,431 | 4/1992 | Nelson | 148/12.3 |
| 5,253,678 | 10/1993 | Furugen | 138/177 |

FOREIGN PATENT DOCUMENTS

| | | |
|---|---|---|
| 50-142743 | 11/1975 | Japan . |
| 61-088914 | 5/1986 | Japan . |
| 58-045319 | 2/1987 | Japan . |
| 63-072419 | 4/1988 | Japan . |
| 63-097308 | 4/1988 | Japan . |
| 1-254314 | 10/1989 | Japan . |

*Primary Examiner*—James F. Hook

*Attorney, Agent, or Firm*—Burns, Doane, Swecker & Mathis, LLP

[57] ABSTRACT

A stainless steel pipe of the bright annealing finish type, having a highly-soothed inner surface according to the present invention is characterized in that the inner surface roughness of the pipe, expressed in Rmax is 1.0 micrometer or less, and suitable as a clean pipe for use in an apparatus for the production of semiconductors. According to the method of production of the present invention, a stainless steel pipe having a highly-smoothed inner surface can be obtained by cold drawing and bright annealing treatment only. By this method, such a treatment that has been considered to be essential, for example, electrochemical polishing can be omitted, so that the production cost can be greatly reduced. The stainless steel pipe of the invention can thus be widely utilized in the fields of the production of semiconductors and the like.

19 Claims, 14 Drawing Sheets

FLOATING PLUG

| Δh (mm) / ℓ (mm) | Inner surface roughness of tubing material drawn by using cylindrical plug Rmax(μm) | | | | | | |
|---|---|---|---|---|---|---|---|
| | 0.005 | 0.01 | 0.02 | 0.04 | 0.06 | 0.08 | 0.10 |
| 0 | 1.3 | 1.0 | 0.7 | 0.7 | 0.4 | 0.3 | |
| 0.25 | 1.3 | 1.0 | 0.7 | 0.5 | 0.3 | 0.3 | |
| 0.50 | 1.3 | 1.0 | 0.7 | 0.5 | 0.3 | 0.3 | Seizure |
| 0.75 | 1.3 | 1.0 | 0.7 | 0.5 | 0.3 | 0.3 | |
| 1.00 | 1.3 | 1.0 | 0.7 | 0.5 | 0.3 | 0.3 | |
| 1.5 | 1.5 | 1.3 | 1.2 | 1.2 | 1.1 | 1.1 | Seizure |
| 3.0 | 1.5 | 1.3 | 1.2 | 1.2 | 1.1 | 1.1 | |

FIG. 14

| $E_1$ (mm) \ $\Delta h$ (mm) | Inner surface roughness of tubing material drawn by using floating plug Rmax(μm) | | | | | | |
|---|---|---|---|---|---|---|---|
| | 0.005 | 0.01 | 0.02 | 0.04 | 0.06 | 0.08 | 0.10 |
| 0.25 | | 0.9 | | 0.5 | | 0.3 | |
| 0.50 | 1.2 | 0.9 | 0.7 | 0.5 | 0.4 | 0.3 | Seizure |
| 0.75 | | 0.9 | | 0.5 | | 0.3 | |
| 1.00 | | 0.9 | | 0.5 | | 0.3 | |
| 1.5 | | 1.3 | | 1.2 | | 1.1 | |
| 3.0 | | 1.3 | | 1.2 | | 1.1 | |

FIG. 15

| Angle $\gamma$ of slanting surface of protruding portion (°) | Rmax of tubing material drawn by floating plug (μm) |
|---|---|
| 5 | 1.3 |
| 10 | 0.7 |
| 20 | 0.6 |
| 30 | 0.6 |
| 40 | 0.6 |
| 50 | 0.6 |
| 60 | Seizure |

Note: $\Delta h = 0.04$mm、$E_1$ $E_2$ = 0.5mm

FIG. 16

| Length of horizontal part of protruding portion $E_2$ (mm) | Cylindrical plug (μm) | Floating plug (μm) |
|---|---|---|
| 0.5 | 0.5 | 0.5 |
| 1.0 | 0.5 | 0.5 |
| 1.5 | 0.5 | 0.5 |
| 2.0 | 0.6 | 0.6 |
| 2.5 | 0.6 | 0.6 |
| 3.0 | Seizure | Seizure |

Note: $\Delta h = 0.04$mm、$E_1$ = 0.5mm

FIG. 17

| Δd (mm) | Δh (mm) | Inner surface roughness (μm) |
|---|---|---|
| 0 | 0 | 1.4 |
| 0.05 | 0.008 | 1.1 |
| 0.10 | 0.016 | 0.9 |
| 0.15 | 0.024 | 0.7 |
| 0.20 | 0.032 | 0.6 |
| 0.25 | 0.040 | 0.6 |
| 0.30 | 0.048 | 0.7 |

FIG. 18

| $E_3$ (mm) | Inner surface roughness Rmax(μm) |
|---|---|
| 0 | 1.2 |
| 0.5 | 0.6 |
| 1.0 | 0.6 |
| 1.5 | 0.8 |
| 2.0 | 1.6 |
| 2.5 | 1.6 |

Note: Δd=0.20mm

FIG. 19

| θ (°) | Inner surface roughness Rmax(μm) |
|---|---|
| 0 | 1.5 |
| 10 | 0.7 |
| 20 | 0.6 |
| 30 | 0.6 |
| 40 | 0.6 |
| 50 | 0.6 |
| 60 | Seizure |

FIG. 20

STAINLESS STEEL PIPE OF BRIGHT ANNEALING FINISH TYPE, HAVING HIGHLY-SMOOTHED INNER SURFACE AND METHOD FOR PRODUCING THE SAME

TECHNICAL FIELD

The present invention relates to a stainless steel pipe of the bright annealing finish type (BA type), having a highly-smoothed inner surface, suitable as a clean pipe for use in an apparatus for the production of semiconductors, and as a method for producing the same.

BACKGROUND ART

Clean pipes are classified, according to the method of the production thereof, into the bright annealing finish type in which a stainless steel pipe after being cold drawn is subjected to bright annealing treatment; the electric polishing finish type (EP type) in which the inner surface of a stainless steel pipe of a bright annealing finish is further smoothed by means of electrochemical polishing; and like method.

It is well known that the inner surface roughness of a clean pipe is closely related to the production of impurities or fine particles and the discharge of water vapor from the inner surface of the pipe. In an apparatus which is required to have a high degree of cleanliness, clean pipes of the electrolytic polishing finish type whose inner surface roughness becomes lower and are expensive, are used.

In the production of a pipe having a smooth inner surface, there has been a conventional method employed in which a tubing material is subjected to cold plug drawing. Cold plug drawing is a method of processing in which a tubing material 85 is cold drawn with the outer and inner surfaces thereof constrained, as shown in FIG. 10, by a fixing die 86 having a round hole and a plug 81, and the outlet-side end of the tubing material 85 chucked (not illustrated). A chemical conversion treatment lubrication and oil lubrication are the general methods of lubrication between the tools (the die 86 and the plug 81) and the tubing material 85, and oil lubrication capable of forming a thin lubricating film is employed in order to obtain highly-smoothed inner and outer surfaces.

A material for a pipe such as a clean pipe which is required to have a more highly-smoothed inner surface is subjected to a highly-smoothing treatment such as electrochemical polishing after it is cold drawn by the above-described method.

Typically, there are two types of methods for cold drawing in which different plugs are used as shown in FIG. 10.

FIG. 10(*a*) shows a method in which a cylindrical plug 81 whose outside diameter is uniform is used. The cylindrical plug 81 is connected with a plug-supporting rod 87. This method is used for producing pipes of relatively large dimensions.

FIG. 10(*b*) shows a method in which a floating plug 82 is used. This method is characterized by the shape of the plug and by the method for supporting the plug. As illustrated in this figure, the floating plug 82 is tapered, and the cone angle $2\beta$ of the plug is smaller than the facial angle $2\alpha$ of the die.

For this reason, those forces which act on the floating plug 82 are the frictional force which acts in the direction of drawing, and, in addition to this, the pushing-back force which acts on the tapered surface of the plug in the direction reverse to the direction of drawing. The frictional force and the pushing-back force are canceled and balanced with each other. Therefore, such a plug-supporting rod 87 as is used in the method using a cylindrical plug shown in FIG. 10(*a*) is not needed, and even if a supporting rod is provided in consideration of operation, almost no force acts on the supporting rod.

Since the floating plug has the above-described characteristics, the method using this plug is commonly adopted to draw a tubing material to obtain, in particular, a pipe whose diameter is small. However, in the case where this plug is used, the balancing position of the plug varies depending upon the state of lubricating films provided on the inner and outer surfaces of the tubing material, or upon the force for drawing the tubing material. Since the change of the balancing position of the plug is extremely obstructive to the operation for drawing the tubing material, proposals for improvements for this change have been made. For instance, Japanese Laid-Open Patent Publication No. 72419/1988 discloses a method in which a plug is maintained at a proper position on a die by balancing the frictional force and the pushing-back force which act, during the process of drawing, on the horizontal surface and the tapered surface of the plug, respectively.

FIG. 11 is a longitudinal section explaining the shape of the plug which is used for drawing a tubing material in the above-described method, and the method of drawing. As illustrated in the figure, a plug 111 has a horizontal surface 112 which provides a uniform outside diameter to the plug, a first tapered surface 113 with which the outside diameter of the plug is decreased toward the direction opposite to the direction of drawing, and a second tapered surface 114 which is continued to the first tapered surface and with which the outside diameter of the plug is increased. Therefore, the forces which act on the horizontal surface 112 and on the second tapered surface 114 when a tubing material is drawn can be balanced, and the plug 111 can thus be maintained at a proper position on the die 115.

The minimum inner surface roughness expressed in Rmax of a pipe obtained by means of the above described conventional cold plug drawing is limited to approximately 1.1 micrometers, for example, when a clean pipe having an outside diameter of 6 mm and a wall thickness of 1 mm is produced by using SUS 304, and it is difficult to make the Rmax lower than this limit. Further, even in the method disclosed in Japanese Laid-Open Patent Publication No. 72419/1988, it is necessary to make the difference between the outside diameters on the inlet side and on the outlet side of the part with the first tapered surface 113 as considerably large as several-tenths mm. When the difference between the outside diameters of the part with the first tapered surface 113 is large, seizure is caused when ordinary oil lubrication is conducted, so that it is necessary to conduct chemical conversion treatment lubrication which is excellent in anti-seizure properties. However, as will be described later, when chemical conversion treatment lubrication is conducted, the lubricating film produced is thick, so that a tubing material after being subjected to drawing will have a high inner surface roughness. It is thus impossible to make the inner surface roughness expressed in Rmax to 1.0 micrometer or less even when squeezing is conducted. Therefore, in order to obtain a pipe which is required to have an inner surface roughness expressed in Rmax of 1.0 micrometer or less, it is essential, as mentioned above, to conduct a highly-smoothing treatment such as electrochemical polishing after cold plug drawing is conducted. As a result, the price of the final product becomes extremely high, approximately four times the price of a pipe produced by conventional cold plug drawing.

Some techniques have been known as methods in which a plug of a specific shape is used when cold plug drawing is conducted in order to bring about special effects on the inner surface of a pipe.

For instance, Japanese Patent Publication No. 7244/1987 discloses a method in which a tubing material is processed by using a plug of a specific shape to form a work-hardened layer on the inner surface of a pipe so as to prevent the stainless steel pipe from being oxidized by water vapor.

FIG. 12(*a–c*) include a side view and longitudinal sections which show the shape of a plug having a protruding portion, used for the above-described processing, and a method of drawing, using the plug. FIG. 12(*a*) and FIG. 12(*b*) are illustrations showing the process of drawing, and FIG. 12(*c*) is a side view of the plug. Shown in this figure is a method in which a work-hardened layer is formed on the inner surface of a tubing material 95 by increasing the inside diameter of the tubing material 95 by the use of plug 91 provided with a protruding portion 94 and a plug-supporting rod 97 as illustrated in the figure. The object of this method is to form a work-hardened layer, and the inner surface roughness obtained, expressed in Rmax is extremely high from 18 to 25 micrometers. Further, in this method, the tubing material 95 is processed without constraining the outer surface thereof, so that it is impossible to obtain 1 micrometer or less of the inner surface roughness expressed in Rmax as in a part of the examples which will be described later.

A method shown in FIG. 13 has also been used as another conventional method of processing. FIG. 13 is a side view, partly in cross section, and a longitudinal section which show the shape of a conventional plug used for increasing the inside diameter of a pipe, and a method of drawing, using the plug. The object of this method is to improve the dimensional accuracy of the inner surface of a pipe such as a steel pipe for a cylinder (in particular, the roundness of the inside of a pipe).

As shown in FIG. 13, plug 101 connected with a supporting rod 107 is so tapered that the diameter of the plug is slightly increased toward the outlet side of drawing. The inside diameter of a tubing material 105 is increased by this plug 101 and a die 106, and, at the same time, the roundness of the inside of the tubing material 105 is improved. However, since the increase of the inside diameter is slightly in this method, the effect of squeezing the inner surface of the tubing material, which will be described later, is small, that is, only a thin layer of shear plastic deformation is formed on the inner surface of the tubing material. It is therefore impossible to obtain a highly-smoothed inner surface which is required for a clean pipe.

As illustrated in the figure, the diameter of the plug 101 is slightly increased toward the outlet side. However, with respect to the wall-thickness-processed part of the tubing material 105, there is no great difference between it and that part of the tubing material obtained by using the conventional plug as shown in FIG. 10(*a*) and FIG. 10(*b*). Therefore, although the roundness of the inside of a pipe can be improved by the plug of this shape, the inner surface roughness of a pipe cannot be improved.

SUMMARY OF THE INVENTION

The object of the present invention is to provide a stainless steel pipe of the bright annealing finish type, having a highly-smoothed inner surface with an inner surface roughness expressed in Rmax of 1.0 micrometer or less, and a method for producing the same, by which a stainless steel pipe of the bright annealing finish type, having a highly-smoothed inner surface can be inexpensively produced without conducting any inner-surface-highly-smoothing treatment such as electrochemical polishing after cold plug drawing is conducted.

The gist of the present invention is a stainless steel pipe of the bright annealing finish type, having a highly-smoothed inner surface, set forth in the following item (1), and a method for producing the same, set forth in the following items (2) to (4):

(1) A stainless steel pipe of the bright annealing finish type, having a highly-smoothed inner surface, characterized in that the inner surface roughness Rmax of the stainless steel pipe is 1.0 micrometer or less.

(2) A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a cylindrical plug, it is subjected to bright annealing treatment to obtain a clean pipe, characterized in that the cold drawing is conducted by using a plug having a ring-like protruding portion provided on a part of the finishing part which is on the hinder part of the plug, with the slanting surface on the inlet side of the ring-like protruding portion kept within a bearing part (a finishing part with a horizontal surface) of the die, followed by conducting bright annealing treatment.

(3) A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a floating plug, it is subjected to bright annealing treatment to obtain a clean pipe, characterized in that the cold drawing is conducted by using a plug having a non-tapered part and a ring-like protruding portion continued thereto on a finishing part which is on the hinder part of the plug, with the slanting surface on the inlet side of the ring-like protruding portion kept within a bearing part (a finishing part with a horizontal surface) of the die, followed by conducting bright annealing treatment.

(4) A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a floating plug, it is subjected to bright annealing treatment to obtain a clean pipe, characterized in that the cold drawing is conducted by using a plug having a ring-like concaved portion on a wall-thickness-processing part which is the tapered part of the plug, followed by conducting bright annealing treatment.

BRIEF DESCRIPTION OF THE DRAWINGS

FIG. 5(*a*) is a general view, and FIG. 5(*b*) is an enlarged view of the part A (the concaved portion and the wall-thickness-processing part).

FIG. 14 is a table showing the results of the measurement of the inner surface roughness of pipes obtained by the use of the cylindrical plug out of the shoulder-type plugs having a protruding portion; and FIG. 15 is a table showing the results of the measurement of the inner surface roughness of pipes obtained by the use of the floating plug.

FIG. 16 is a table showing the results of the examination on the effects, on the inner surface roughness of a pipe obtained by using the shoulder-type floating plug having a protruding portion, of the angle $\gamma$ of the slanting surface of the protruding portion provided on the plug.

Further, FIG. 17 is a table showing the results of the examination on the effects, on the inner surface roughness of a pipe obtained by using the shoulder-type cylindrical plug having a protruding portion or the shoulder-type floating plug having a protruding portion, of the length $E_2$ of the horizontal part of the protruding portion provided on the plug, and of a coating provided on the plug.

FIGS. 18 and 19 are tables showing the results of the measurement of the inner surface roughness of pipes obtained by using the floating plug having a concaved portion, with the depth $\Delta d$ of the concaved portion or $E_3$ changed. Further, FIG. 20 is a table showing the results of the examination of the effects of the angle $\theta$ on the inner surface roughness of a pipe obtained by the use of the floating plug having a concaved portion.

BEST MODE FOR CARRYING OUT THE INVENTION

Figure 1A:
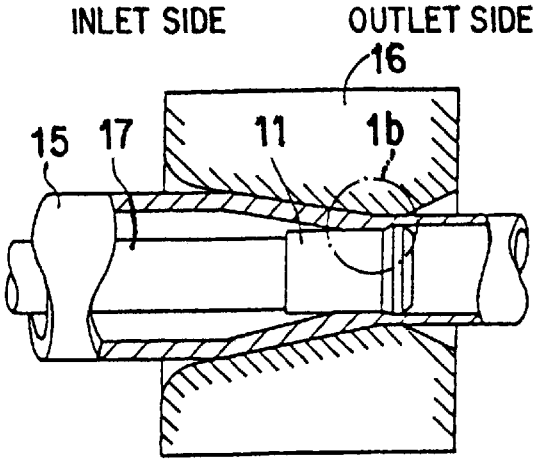
FIG. 1(*a*) is a side view, partly in cross section, and FIG. 1(*b*) a longitudinal section which show the shape of a shoulder-type cylindrical plug having a protruding portion, and a method of drawing, using the cylindrical plug.

As the methods for lowering the roughness on the surface of a processed metal, a method has been known in which the roughness on the surface of a tool is lowered, and a known method in which a lubricating oil capable of forming a thin lubricating film is used. The inventors of the present invention found that when the surface of a material to be processed, that is, the inner surface layer of a tubing material is squeezed, in addition to applying the above known techniques, by using a tool having a smooth surface (low roughness) to concentrate thereon shear plastic deformation, the shear plastic deformation is concentrated on the surface layer of the material to be processed, and the surface of the material fits the surface of the tool, whereby the surface roughness is still lowered very much. The present invention has been accomplished on the basis of this finding.

The object of the method of the present invention is to lower the roughness on the inner surface of a pipe by conducting cold drawing only. To attain this object, it is necessary to conduct "squeezing" so that shear plastic deformation can be concentrated on the inner surface layer of the pipe. The methods for conducting "squeezing" in the present invention include a method referred to as the first method of production (the method of production described in the previously-mentioned item (2) or (3)), in which a shoulder-type plug having a protruding portion is used, and a method referred to as the second method of production (the method of production described in the previously-mentioned item (4)), in which a floating plug having a concaved portion is used.

The action and effects of the stainless steel pipe having a highly-smoothed inner surface and the method for producing the same according to the present invention will now be explained below.

1. Inner Surface Roughness of Stainless Steel Pipe of Bright Annealing Finish Type, Having Highly-Smoothed Inner Surface The reason why the inner surface roughness expressed in Rmax of the stainless steel pipe of the present invention, having a highly-smoothed inner surface is restricted to 1.0 micrometer or less will be explained below.

The inner surface roughness expressed in Rmax of a pipe drawn by the conventional method is limited to approximately 1.1 micrometers, and cannot be drawn to 1.0 micrometer or less. For this reason, there has been no such stainless steel pipe produced by means of cold drawing that has an inner surface roughness expressed in Rmax of 1.0 micrometer or less. At the current level of technology, the surface roughness of a plug, expressed in Rmax is limited to approximately 0.1 micrometers. Theoretically, the inner surface roughness of a tubing material can be improved to this degree, but it is, in practice, limited to 0.3 micrometers.

However, if the surface roughness of a plug, expressed in Rmax can be made to 0.1 micrometers or less, the inner surface roughness of a pipe can be drawn much lower. On the other hand, when the inner surface roughness of a pipe, expressed in Rmax is in excess of 1.0 micrometer, the reduction of fine particles or impurities cannot be attained as desired.

2. First Method of Production (A case where a shoulder-type plug having a protruding portion is used)

Figure 1B:
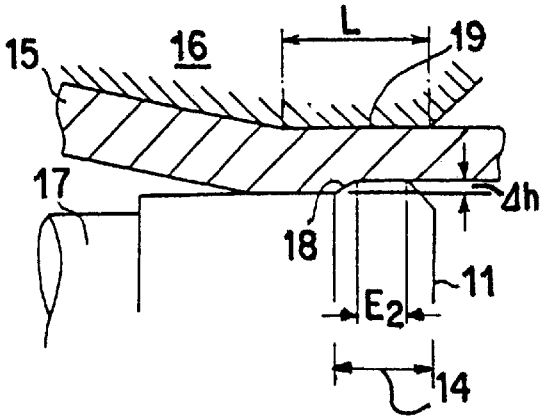

FIGS. 1(*a–b*) are a side view, partly in cross section, and a longitudinal section which show the shape of a shoulder-type cylindrical plug having a protruding portion, and a method of drawing, using the cylindrical plug.

In the first method of production according to the present invention, a ring-like protruding portion (hereinafter referred to simply as a protruding portion) 14 having an increased diameter is provided, in the case of a cylindrical plug as shown in FIG. 1, on the hinder part of the cylindrical plug 11 connected with a plug-supporting rod 17, and the inner surface of a tubing material 15 is squeezed by this protruding portion in order to concentrate shear plastic deformation on the inner surface of a pipe by conducting cold plug drawing. Namely, within the length L of the finishing part with a horizontal surface (bearing part) 19 of the die 16, a predetermined amount Δh of wall-thickness processing is further given by the protruding portion 14 provided on the cylindrical plug 11 after wall-thickness processing is conducted by a die 16 and the cylindrical plug 11.

At this moment in the process, it is the slanting surface 18 on the inlet side of the protruding portion 14 that is brought into contact with the inner surface of the tubing material 15 to give the amount Δh of wall-thickness processing. When the amount Δh of wall-thickness processing is given under such a state that the slanting surface 18 is within the length L of the finishing part with a horizontal surface (bearing part) 19 of the die 16 during the process of drawing, that is, under such a state that the outside diameter of the tubing material 15 is constrained, shear plastic deformation is concentrated on the inner surface of the tubing material, whereby the effect of improving the inner surface roughness can be enhanced. As a result, it is possible to make the inner surface roughness expressed in Rmax to 1.0 micrometer or less.

When the slanting surface 18 of the protruding portion 14 is in the bearing part 19, the outside diameter and the wall thickness of the tubing material 15 are determined by the die 16 and the cylindrical plug 11 before the tubing material 15 is squeezed by the protruding portion 14. Therefore, the amount Δh of wall-thickness processing becomes constant without being affected by the uniformity of the wall thickness and the roundness of the mother pipe, and the difference in the inner surface roughness after the process of drawing becomes small. After squeezing is conducted (the position on the outlet side, posterior to the slanting surface 18), the inside and outside diameters of the tubing material 15 are kept constant, and wall-thickness processing is not conducted. Therefore, seizure is also not caused between the cylindrical plug 11 and the inner surface of the tubing material 15.

When the slanting surface 18 gets out of the bearing part 19, and goes to the outlet side, since the outer surface of the tubing material 15 is not constrained, a part of the amount Δh of wall-thickness processing is absorbed in the increased outside diameter of the tubing material 15. As a result, the effect of improving the inner surface roughness is drastically decreased as compared with the case where the outer surface of the tubing material 15 is constrained. It is thus impossible to make Rmax to 1.0 micrometer or less. Furthermore, when it is tried to enhance the effect of improving the inner surface roughness by increasing the amount Δh of wall-thickness processing, seizure is caused between the cylindrical plug 11 and the inner surface of the tubing material 15.

When the slanting surface 18 gets out of the bearing part 19 and comes to the inlet side, the outside diameter of the tubing material 15 is reduced by the die 16 at a position on the outlet side, posterior to the slanting surface 18 after the tubing material 15 is squeezed by the slanting surface 18. The inside diameter is thus kept constant by plug 11, whereby the material 15 undergoes wall-thickness processing. When the squeezing is conducted by the slanting surface 18, the amount of a lubricating oil existing between the surface of plug 11 and the inner surface of the tubing material 15 is decreased, and the thickness of the lubricating oil film becomes too thin. As a result, the oil film is partially ineffective. Seizure is thus caused if the tubing material 15 is subjected to wall-thickness processing after it is squeezed. For the above-described reason, when the slanting surface 18 gets out of the bearing part 19 to the inlet side, it is impossible to make the inner surface roughness expressed in Rmax to 1.0 micrometer or less.

The above-described relative position of the protruding portion 14 to the bearing part 19 of the die can be set up by adjusting the length of the plug-supporting rod 17 in the case of the cylindrical plug 11.

Figure 2A:
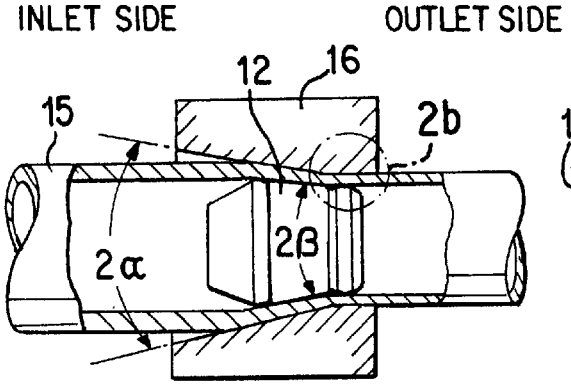
FIG. 2(*a*) is a side view, partly in cross section, and FIG. 2(*b*) is a longitudinal section which show the shape of a shoulder-type floating plug having a protruding portion, and a method of drawing, using the floating plug.
Figure 2B:
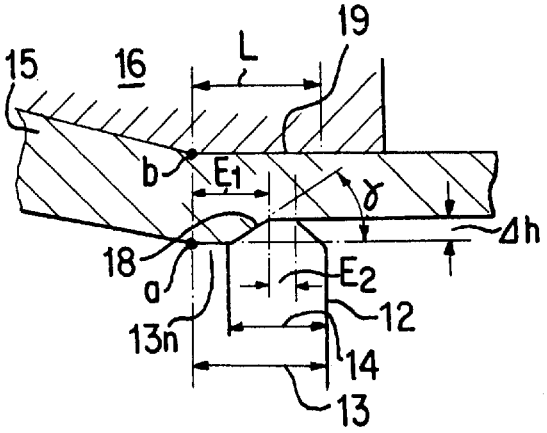

FIGS. 2(*a–b*) are a side view, partly in cross section, and a longitudinal section which show the shape of a shoulder-type floating plug having a protruding portion, and a method of drawing, using the floating plug.

In the case where a floating plug is used in the first method of production according to the present invention, a protruding portion 14 which has, on the inlet side, a slanting surface 18 with an increased diameter is continuously provided next to the non-tapered part 13*n* of the finishing part 13 of the floating plug 12 as shown in FIG. 2 so as to squeeze the inner surface of a tubing material 15. Namely, after wall-thickness processing is conducted by the die 16 and the non-tapered part 13*n* of the finishing part 13, a predetermined amount Δh of wall-thickness processing is further produced by the die 16 and the protruding portion 14 of the floating plug 12 at the slanting surface 18 on the inlet side of the protruding portion 14 provided on the finishing part 13.

Also in this case, the amount Δh of wall-thickness processing is produced under such a state that the slanting surface 18 on the inlet side of the protruding portion 14 is within the length L of the finishing part with a horizontal surface (bearing part) 19 of the die 16 during the process of drawing, that is, under a state that the outer surface of the tubing material 15 is constrained.

The reason for the above-described restriction imposed in the method using the floating plug is the same as that in the previously-mentioned case where the cylindrical plug is used.

In the course of drawing the tubing material, the floating plug 12 floats so that the point "a" shown in FIG. 2(*b*), which is the turning point from the tapered part of the plug to the horizontal part (non-tapered part) of the finishing part 13, and the point "b" shown in FIG. 2(*b*), which is the turning point from the tapered part to the bearing part 19 of the die 16, can almost line up with each other on the axial direction. When the distance $E_1$ between the inlet-side end of the bearing part L of the die and the point at which the horizontal part of the protruding portion 14 begins is in excess of the length L of the bearing part of the die 16, the slanting surface 18 on the inlet side of the protruding portion 14 gets out of the bearing part 19. It is therefore necessary to select the dimensions of the floating plug 12 and the die 16 so that the relation between $E_1$ and L can be $E_1 \leqq L$.

It is the slanting surface 18, which is anterior to the horizontal part $E_2$ of the protruding portion 14, that practically squeezes the inner surface of the tubing material 15. Therefore, the length $E_2$ of the horizontal part of the protruding portion does not basically affect the inner surface roughness of the tubing material after being subjected to drawing. However, when the length of the horizontal part is too long, seizure is caused between this part and the inner surface of the tubing material. The desirable length $E_2$ of the horizontal part of the protruding portion is less than 3.0 mm.

The action and effects obtainable when a floating plug is used in the first method of production according to the present invention will be explained by referring to FIG. 3.

Figure 3:
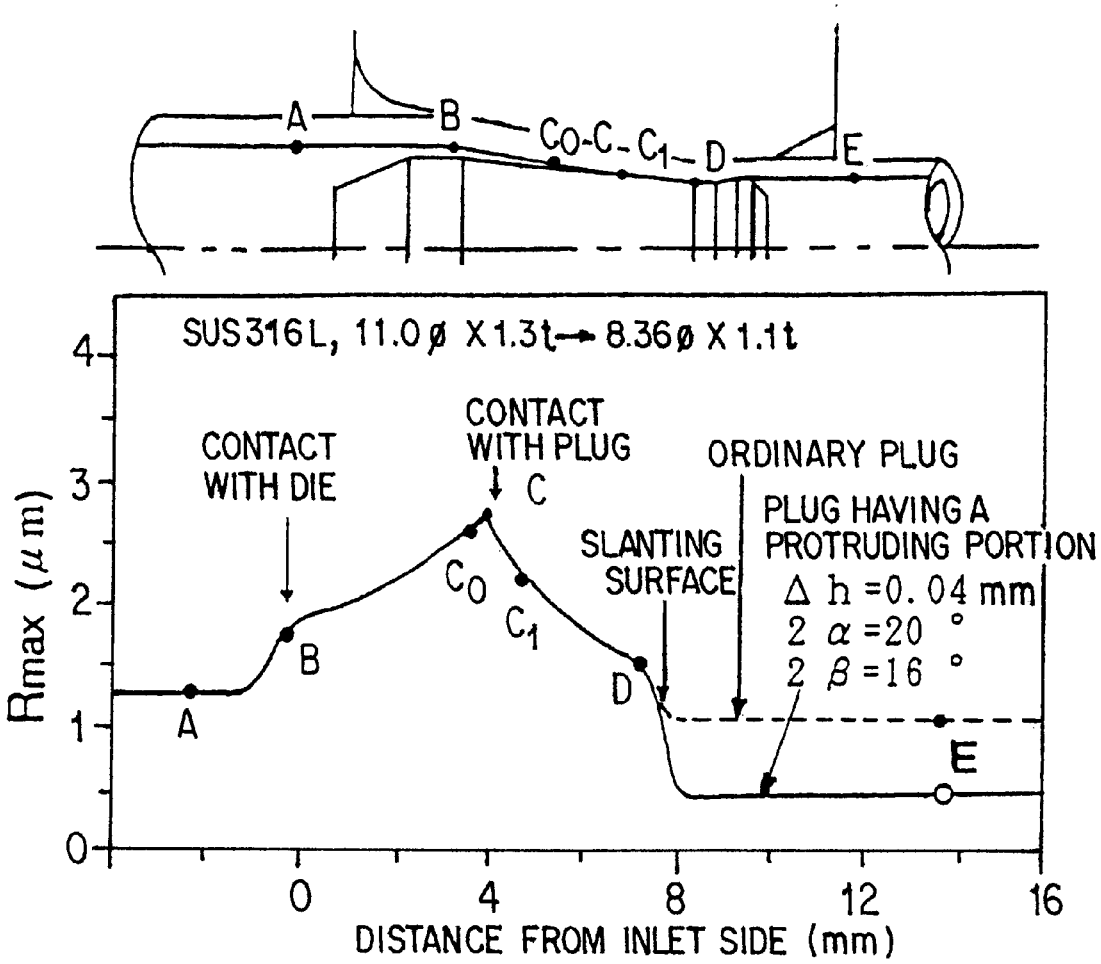
FIG. 3 is a graph showing a change in the inner surface roughness Rmax in the course of drawing conducted by the use of the shoulder-type floating plug having a protruding portion. Further.

FIG. 3 is a graph showing a change in the inner surface roughness Rmax in the course of drawing conducted by using the shoulder-type floating plug having a protruding portion. Point B is a position at which the tubing material comes into contact with the die, point C is a position at which the inner surface of the pipe comes into contact with the plug, and point D is a position at which the tapered part of the plug is turned to the non-tapered part which is the finishing part. As shown in this graph, the inner surface roughness of the pipe is increased in the region of sink drawing (B→C), which is before the inner surface of the pipe comes into contact with the plug. It is decreased in the region of wall-thickness processing (C→D), which is after the inner surface of the pipe comes into contact with the plug, and further decreased by the slanting surface of the protruding portion after processing is conducted at the non-tapered part. After the above processing, an Rmax of approximately 0.5 micrometers can be obtained satisfactorily. The term "ordinary plug" described in FIG. 3 means a plug having no protruding portion (Δh=0), and a change in Rmax in the case where such an ordinary plug is used is shown by a dotted line. Namely, the graph shows a change in Rmax until processing is conducted at the non-tapered part which is the finishing part.

The effect of the height of the protruding portion, that is, the amount Δh of wall-thickness processing is such that the amount of squeezing is increased as Δh is increased, and the inner surface roughness of the tubing material after subjected to drawing also becomes lower. However, when Δh is too large, the surface layer is severely processed, so that seizure tends to be caused. Moreover, the inner surface of the tubing material is detached from the surface of the plug during the processing, and the amount of squeezing becomes smaller than Δh. The desirable range of Δh is from 0.01 to 0.08 mm.

Figure 4:
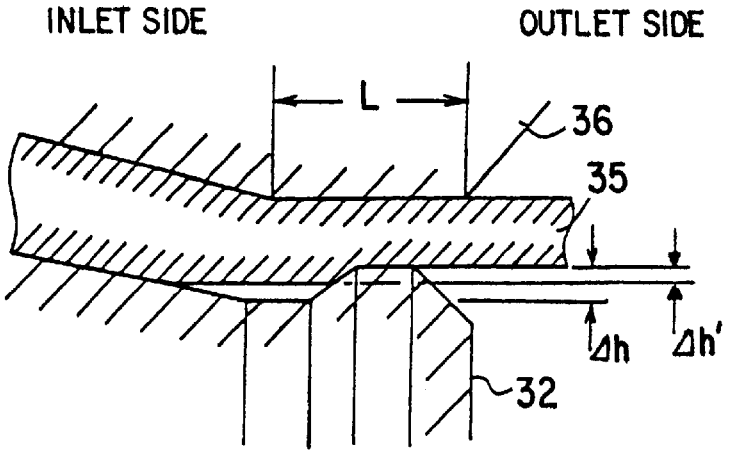
FIG. 4 is a longitudinal section showing the state that the inner surface of a tubing material is detached from the shoulder-type floating plug having a protruding portion when drawing is conducted by using the floating plug.

FIG. 4 is a longitudinal section showing the state at the time when the inner surface of the tubing material is detached from the plug in the case where drawing is conducted by using the shoulder-type floating plug having a protruding portion within die 36. As illustrated in this figure, when Δh is made too large, the inner surface of the tubing material 35 is detached from tapered and non-tapered surfaces of the floating plug 32 during the processing, and the amount of Δh' of wall-thickness processing conducted by squeezing becomes smaller than the practical height Δh of the protruding portion. The effect of improving the inner surface roughness is thus determined by Δh', so that it cannot be enhanced even if Δh is made larger than the upper limit of the above-described range.

For this reason, it is preferable that the height of the protruding portion, that is, the amount Δh of wall-thickness processing be made equal to or less than the critical value at which the detachment of the inner surface of the tubing material from the surface of the plug begins to occur.

Even in the case where a predetermined amount Δh of wall-thickness processing is given to the inner surface of the tubing material, the effect of the angler formed with the slanting surface of the protruding portion and the non-tapered part which is the finishing part should be taken into consideration. When the angle γ of the slanting surface is too small, wall-thickness processing gently proceeds during the process of squeezing, so that the squeezing effect cannot be fully obtained. It is thus impossible to obtain an Rmax of 1.0 micrometer or less. On the other hand, when the angle γ of the slanting surface is too large, wall-thickness processing proceeds drastically, so that seizure tends to be caused on the slanting surface. The desirable range of the angle γ of the slanting surface is from 10° to 50° as shown in the examples, which will be described later.

3. Second Method of Production (A case where a floating plug having a concaved portion is used)

Figure 5A:
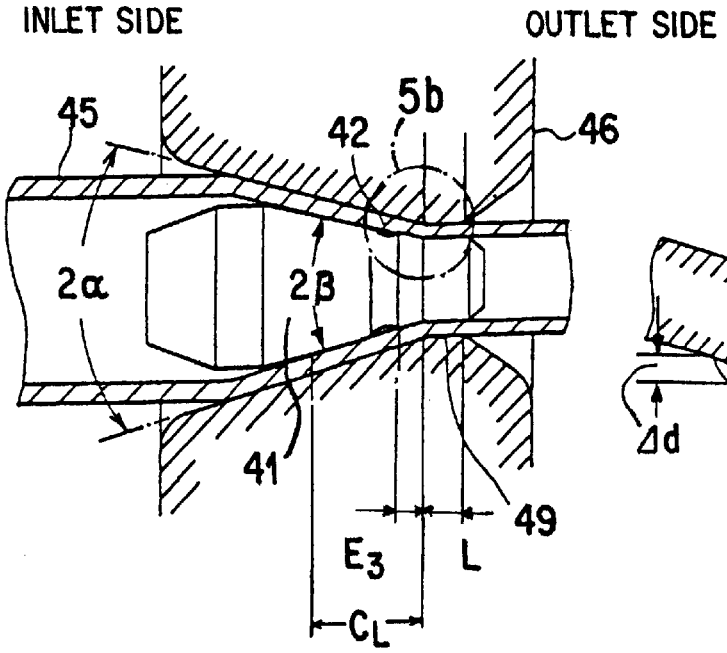
FIG. 5(*a*) is a side view and FIG. 5(*b*) is a longitudinal section which show the shape of a floating plug having a concaved portion, and a method of drawing, using the floating plug.
Figure 5B:
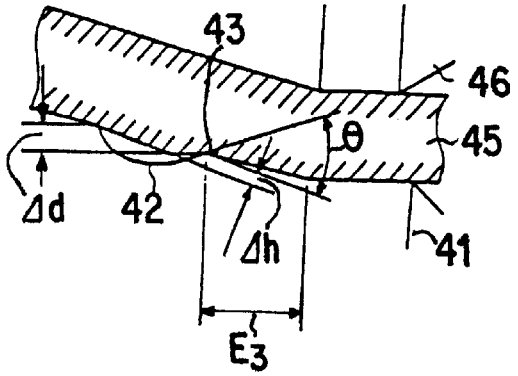

FIGS. 5(*a–b*) are a side view and a longitudinal section which show the shape of a floating plug having a concaved portion, and a method of drawing, using the floating plug. FIG. 5(*a*) is a general view, and FIG. 5(*b*) is an enlarged view of the part A (the concaved portion and the wall-thickness-processing part).

As illustrated in this figure, even in the case where a concaved portion 42 is provided on the inlet side of the wall-thickness-processing part which is the tapered part of a floating plug 41, that is, an approach part, the inner surface of a tubing material 45 is squeezed at a squeezing point 43 which is on the edge on the outlet side of the concaved portion 42 and a die 46. At this moment in the process, the same effect is obtained as in the case where a plug provided with a protruding portion is used, and the roughness on the inner surface of the tubing material becomes lower. As a result, it becomes possible to obtain an inner surface roughness expressed in Rmax of 1.0 micrometer or less. It is noted that Δd shown in FIG. 5(*b*) is called the depth of the concaved portion for convenience. Δh represents the amount of wall-thickness processing (the height of the protruding portion), and θ represents the angle formed with the contour of the plug 41 in the vicinity of the squeezing point 43 which is on the edge on the outlet side of the concaved portion 42, and the tapered surface of the plug.

The effect of this concaved portion 42 on the improvement of the inner surface roughness of the tubing material is enhanced by squeezing as the inner surface of the tubing material 45 gets nearer the bearing part (horizontal part) 49 of the plug.

More specifically, it is necessary to provide this concaved portion 42 on the outlet side posterior to the point (C shown in FIG. 6, which will be described later) at which the inner surface of the tubing material 45 begins to touch with the floating plug 41. Namely, it is necessary that the concaved portion 42 be entirely within the region of wall-thickness processing (C to D shown in FIG. 6, which will be described later) in which the tapered part of the plug comes into contact with the inner surface of the tubing material 45.

The reason for the above is as follows. Before the inner surface of the tubing material 45 comes into contact with the plug 41 (B to C shown in FIG. 6, which will be described later), the inner surface roughness is high. Although the inner surface roughness is lowered when the tubing material is squeezed at the squeezing point 43 (F shown in FIG. 6, which will be described later) which is on the edge on the outlet side of the concaved portion 42, it is impossible to obtain a Rmax of 1.0 micrometer. After the squeezing is conducted, the shape of the plug having this concaved portion 42 is the same as that of an ordinary floating plug. Therefore, it is also impossible to make the inner surface roughness expressed in Rmax to 1.0 micrometer or less. It becomes possible to make the inner surface roughness expressed in Rmax to 1.0 micrometer or less by squeezing the inner surface of a tubing material after the roughness thereof is once made lower by bringing the inner surface of the tubing material 45 into contact with the plug 41.

Upon the determination of $E_3$ shown in FIGS. 5(*a–b*) (the distance between the outlet-side end of the tapered part of the plug and the squeezing point which is on the edge on the outlet side of the concaved portion), drawing is conducted by using the same mother pipe, die and lubricating oil, and an ordinary floating plug of the same dimensions, having no concaved portion. In this process, the processing is suspended before the tubing material is completely drawn out from the die, and the portion under processing is broken in half, thereby confirming the position at which the inner surface of the tubing material begins to come into contact with the plug, and the region of wall-thickness processing. The position of $E_3$ is thus determined so that the concaved portion can entirely be within this region.

Specifically, when the length of the region of wall-thickness processing which is on the tapered part of the plug is referred to as $C_L$, it is desirable that the range of $E_3$ fulfill the following inequality (1):

$$E_3<[C_L\ \Delta d/\tan\beta] \quad (1)$$

A smaller $E_3$ brings about a greater effect in improving the inner surface roughness as long as $E_3$ fulfills the above-described condition. Therefore, it is desirable that $E_3$ fulfill the following inequality (2):

$$0\leq E_3<[C_L\ \Delta d/\tan\beta] \quad (2)$$

Figure 6:
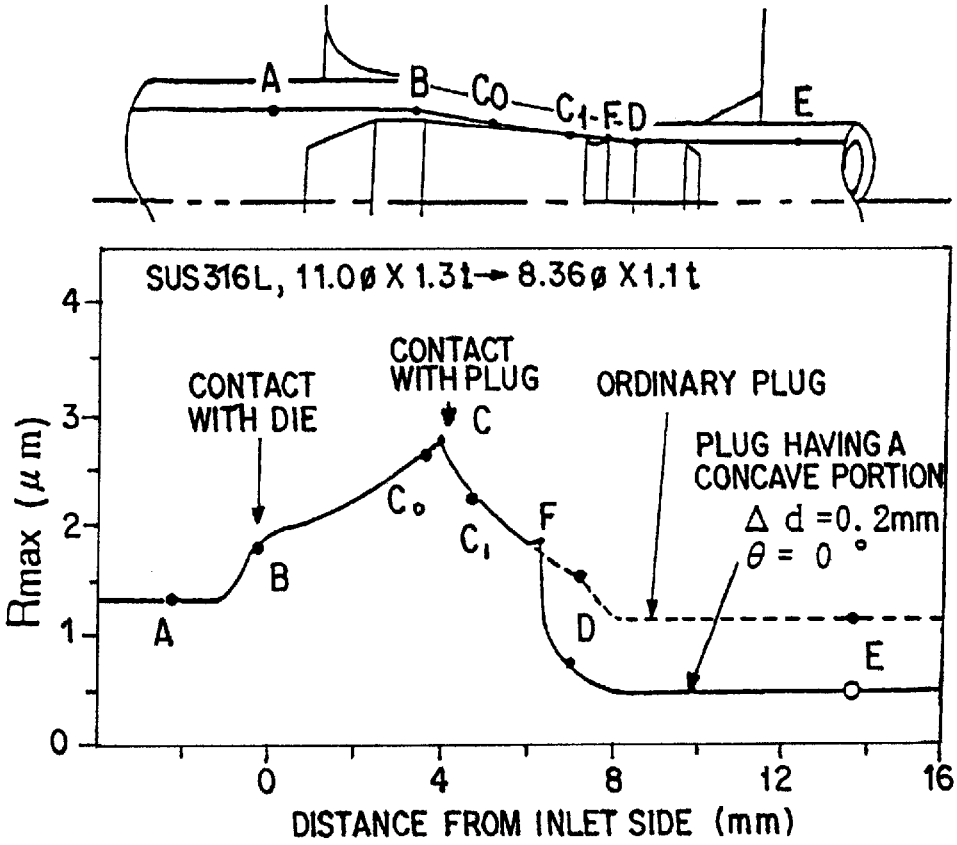
FIG. 6 is a graph showing a change in the inner surface roughness Rmax in the course of drawing conducted by the use of the floating plug having a concaved portion.

FIG. 6 is a graph showing a change in the inner surface roughness Rmax in the case where drawing is conducted by using the floating plug having a concaved portion. Point B is the position at which the tubing material comes into contact with the die, point C is the position at which the tubing material comes into contact with the plug, point D is the position at which the tapered part of the plug is turned to the horizontal part, and point F is the position at which the tubing material is squeezed by the edge on the outlet side of the concaved portion. The inner surface roughness of the pipe is increased in the region of sink drawing (B→C), which is before the tubing material comes into contact with the die. It is decreased in the region of wall-thickness processing (C→F→D), which is after the tubing material comes into contact with the plug, and drastically decreased when the tubing material is squeezed at the point F between C and D. After the processing, a Rmax of approximately 0.5 micrometers can be obtained satisfactorily. The term "ordinary plug" shown in FIG. 6 means a plug having no concaved portion (Δd=0), and a change in Rmax in the case where such an ordinary plug is used is shown by a dotted line.

With respect to the shape of the concaved portion 42, when the depth Δd of the concaved portion is increased, the amount Δh of wall-thickness processing given by squeezing is increased, and the effect of improving the inner surface roughness is enhanced. However, a free surface is also increased along with the increase of Δd, so that the inner surface roughness on such a surface becomes high. As a result, the effect of improving the inner surface roughness obtainable by squeezing is decreased. Namely, when Δd is too large, the effect of improving the inner surface roughness is canceled, and seizure tends to be caused between the inner surface of the tubing material and the plug.

However, it is not Δd but the amount Δh of wall-thickness processing given by squeezing that determines the condition for the occurrence of seizure. Δh is determined by the facial angle 2α of the die, the angle 2β of a taper provided on the plug and Δd, and geometrically obtained by the following equation (3):

$$\Delta h=[\Delta d\cdot\sin\beta\cdot(\tan\alpha-\tan\beta)]/(\tan\alpha\cdot\tan\beta) \quad (3)$$

The desirable range of Δh is from 0.01 to 0.08 mm as in the case of the shoulder-type floating plug having a protruding portion.

When the angle θ shown in FIG. 5(*b*) is too small, the wall-thickness processing proceeds slowly by squeezing, so that the effect of improving the inner surface roughness becomes small. It is therefore impossible to obtain a Rmax of 1.0 micrometer or less. On the other hand, when the angle θ is too large, the wall-thickness processing proceeds drastically, so that seizure is caused between the inner surface of the tubing material and the plug. The desirable range of θ is from 10° to 50°.

4. Materials for Tools, Lubricant, Etc.

When shear plastic deformation is concentrated on the inner surface of a pipe by squeezing as in the method (the first and second methods of production) of the present invention, a work-hardened layer is formed, and crystal grains are finely divided. In the case of stainless steel pipes, the corrosion resistance is also improved when crystal grains are finely divided.

It is better to make the surface roughness of the plug lower than the required inner surface roughness of a tubing material. When the surface roughness of the plug is higher than the desired inner surface roughness, the inner surface roughness of the tubing material after the process of drawing also becomes high. It is therefore desirable that the roughness on the surface of the plug be made as low as possible.

Those materials which have high hardness, such as sintered hard alloys are favorable as the materials for the die and the plug. In the case where the tubing material is a material which readily undergoes seizure, it is desirable to coat the surface of the die and that of the plug with a material which is excellent in antiseizure properties, such as TiCN.

As a lubricant for use in the process of drawing, it is desirable to use one which can form a thin lubricating film, for example, a mixed oil of sulfurized oil and chlorinated paraffin.

After the process of cold drawing, removal of lubricant is conducted, and bright annealing treatment is then carried out in the conventional manner. When the bright annealing treatment is carried out in an oxidizing atmosphere, scale is produced, and the inner surface roughness of the tubing material becomes high. Moreover, the scale deposited on the inner surface becomes particles, so that the properties required for a clean pipe are impaired. In order to prevent the above, bright annealing is conducted by the use of a hydrogen furnace or vacuum heating furnace where scale is not produced.

Thereafter, a treatment of bend straightening is carried out, when necessary. However, in the case of the stainless steel pipe of the bright annealing finish type, having a highly-smoothed inner surface which the present invention does, it is not necessary to carry out a highly-smoothing treatment such as electrolytic polishing, which increases the production cost. In the case where a pipe having a more highly-smoothed inner surface when Rmax is less than 0.3 micrometers is required depending upon the use thereof, it is necessary to conduct electrochemical polishing or a like method, but the time for polishing can be drastically shortened.

The action and effects of the method of the present invention will now be explained by referring to the following specific examples.

1. A case where a shoulder-type plug having a protruding portion is used

Mother pipes made of SUS316L, having an outside diameter of 11 mm, a wall thickness of 1.3 mm and an inner surface roughness expressed in Rmax of 1.8 micrometers ware subjected to cold drawing, using two types of plugs, a cylindrical plug and a floating plug, thereby obtaining pipes having an outside diameter of 8.4 mm and a wall thickness of 1.2 mm.

Figure 7:
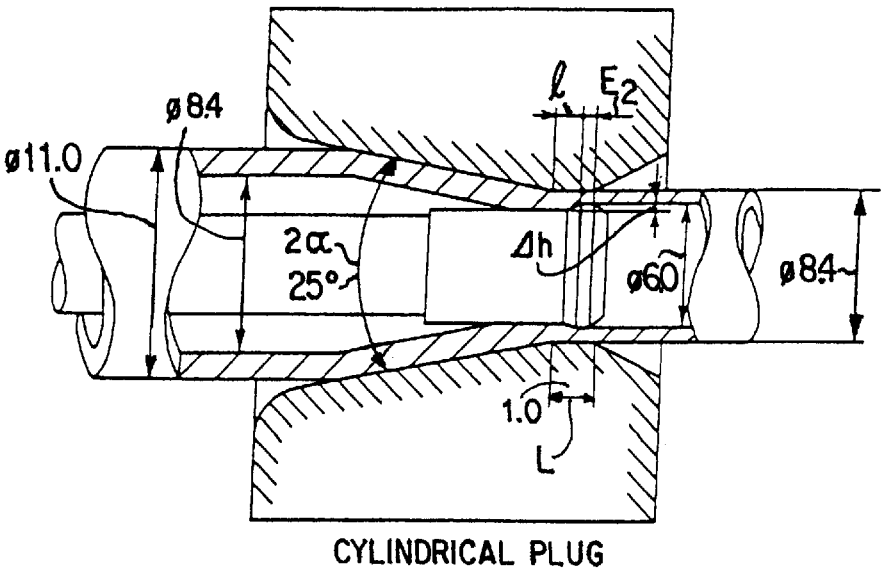
FIG. 7 is a side view, partly in cross section, and a longitudinal section which show the dimensions and the shape of the shoulder-type cylindrical plug having a protruding portion, used in the example, and a method of drawing, using the cylindrical plug.

First, a case where a cylindrical plug was used will be explained. The shape and dimensions of the cylindrical plug used are shown in FIG. 7. The height Δh of the protruding portion has a range of 0.005 to 0.10 mm.

A sintered hard alloy (equivalent to JIS V20) having a surface roughness expressed in Rmax of 0.1 micrometers was used as the material for the die and the plug.

Oil lubrication was adopted for lubrication, and the cold drawing was conducted with a lubricating oil (a mixed oil of sulfurized oil and chlorinated paraffin) applied to the inner and outer surfaces of the pipe.

The cold drawing was conducted by adjusting the length of the plug-supporting rod so that the distance 1, shown in FIG. 7, between the inlet-side end of the bearing part L (L: 1.0 mm) of the die and the point at which the horizontal part of the protruding portion begins would be changed from 0 to 3.0 mm, and Rmax was determined from the inner surface roughness. The above-described conditions and the results are shown in FIG. 14.

As shown in FIG. 14, when the position at which the horizontal part of the protruding portion begins is outside the bearing part of the die, having the length L, that is, when the protruding portion gets out of the bearing part of the die to the outlet side, the effect of improving the inner surface roughness is decreased, and an Rmax of 1.0 micrometer or less cannot be obtained. When l is 1.0 mm or less, that is, when the position at which the horizontal part of the protruding portion begins is inside the bearing part of the die, Rmax can obtain stability, and is not greatly changed by the change of l.

With respect to the height Δh of the protruding portion, 0.005 mm of Δh is too small, and the effect of improving the inner surface roughness obtainable by squeezing is small. It is thus impossible to obtain an Rmax of 1.0 micrometer or less. On the other hand, when Δh is as extremely large as 0.10 mm, seizure was caused. It can thus be known that the preferable range of Δh is from 0.01 to 0.08 mm.

Next, a case where a floating plug is used will be explained. The shape and dimensions of the floating plug used are shown by the general view and the enlarged view of part A in FIGS. 8(*a–b*). Also in this case, the height Δh of the protruding portion has a range of 0.005 to 0.10 mm. Further, the material for the die and the plug, the surface roughness thereof, and the conditions for the lubricating oil were made the same as those in the case where the cylindrical plug was used.

Cold drawing was conducted under such a condition that the distance E, between the inlet-side end of the bearing part L (L: 1.0 mm) of the die and the position at which the horizontal part of the protruding portion begins was changed from 0.25 to 3.0 mm, and Rmax was determined as the inner surface roughness. The above described conditions and the results are shown in FIG. 15.

As shown in FIG. 15, 0.005 mm is too small as the height Δh of the protruding portion, so that the effect of improving the inner surface roughness cannot be obtained as in the case where the cylindrical plug is used. It is thus impossible to obtain an Rmax of 1.0 micrometer or less. On the other hand, when the height Δh was 0.1 mm, seizure was caused. It can thus be proven that the desirable range of the height Δh is from 0.01 to 0.08 mm.

When $E_1$ is in excess of 1.0 mm, that is, when it is longer than the length L of the bearing part of the die, the protruding portion gets out side of the bearing part of the die to the outlet side of the die, so that the effect of improving the inner surface roughness is decreased. It is therefore impossible to obtain a Rmax of 1.0 micrometer or less. When $E_1$ is equal to or shorter than the length of the bearing part of the die, that is, when the protruding portion is inside the bearing part of the die, the effect of improving Rmax can be obtained satisfactorily. Therefore, it can be proven that it is desirable to control $E_1$ to be equal to or shorter than L.

Thus, it is possible to make the inner surface roughness of a tubing material after subjected to drawing expressed in Rmax to 1.0 micrometer or less by using either the shoulder-type cylindrical plug having a protruding portion or the shoulder-type floating plug having a protruding portion. The inner surface roughness of the tubing material remains unchanged even if bright annealing treatment is then carried out in accordance with the ordinary method. A clean pipe of the BA type, having the above-described inner surface roughness Rmax can thus be produced.

The surface roughness expressed in Rmax of the plug used in this example was made to 0.1 micrometers, which can be obtained by the present technology. The inner surface roughness of the tubing material after subjected to drawing was slightly higher than the surface roughness of the plug, but nearly equal to the level of the surface roughness of the plug. If a plug having a lower surface roughness is used, it is possible to attain a further reduction in the inner surface roughness of the tubing material.

Further, with respect to the shoulder-type floating plug having a protruding portion, the effect on the improvement on the inner surface roughness of a tubing material, of the angler of the slanting surface of the protruding portion provided on the plug, was examined.

Figure 8A:
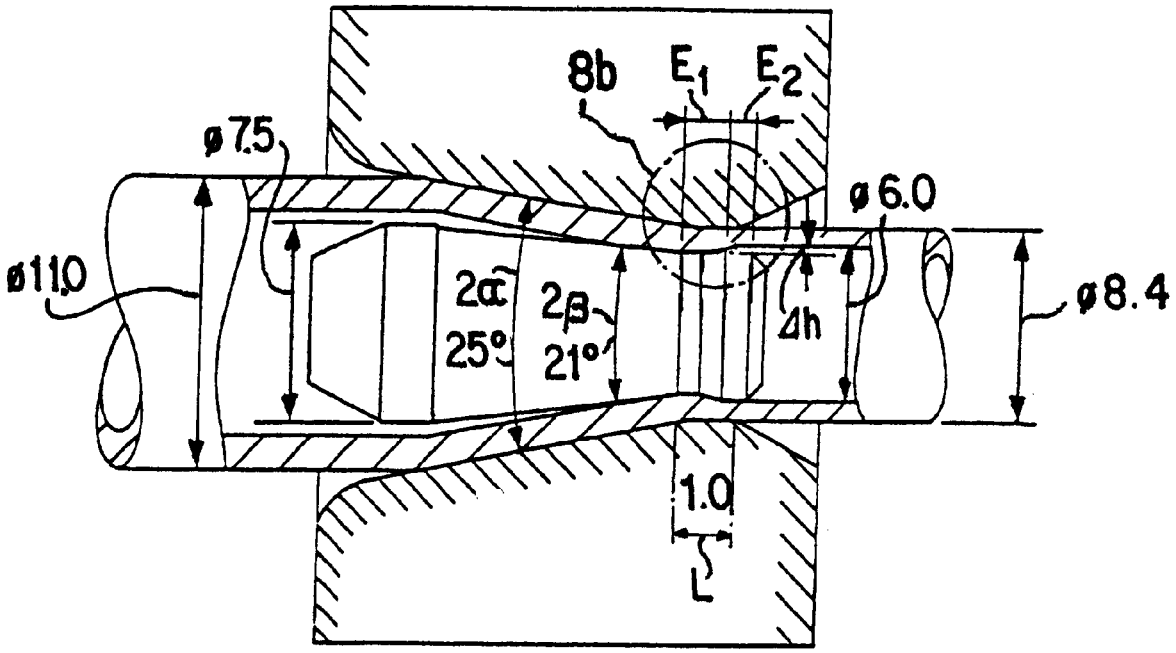
FIG. 8(*a*) is a side view, partly in cross section, and FIG. 8(*b*) a longitudinal section which show the dimensions and the shape of the shoulder-type floating plug having a protruding portion, used in the example, and a method of drawing, using the floating plug. On the other hand, FIGS. 9(*a–b*) are each a side we showing the dimensions and the shape of the floating plug having portion, used in the example.
Figure 8B:
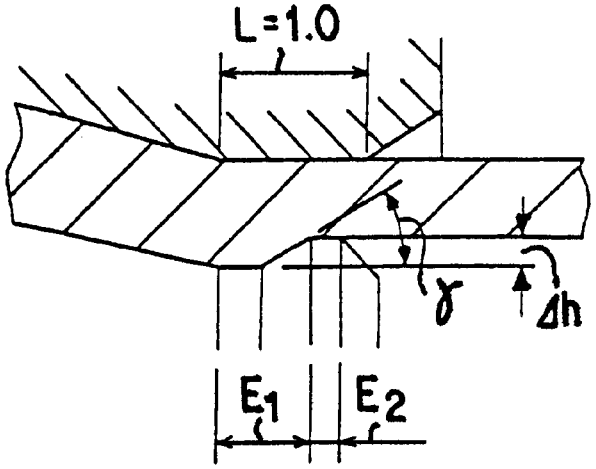

The basic shape and dimensions of the plug and the die used are the same as those shown in FIG. 8. The inner surface roughness was measured under the following conditions: the height Δh of slanting of the protruding portion was 0.04 mm, $E_1E_2$ was 0.5 mm, and the angle γ was changed from 5° to 60°. The results are shown in FIG. 16.

As is clear from FIG. 16, when the angle γ was 5°, Rmax was 1.3 micrometers, and the squeezing effect obtained was small; and when the angle γ was 60°, the wall-thickness processing proceeded drastically, so that seizure was caused on the slanting surface of the protruding portion. It is therefore desirable to control the angler within the range of 10° to 50°. The same examination was made also on the shoulder-type cylindrical plug having a protruding portion, and it was confirmed that the results obtained were the same as the above.

Next, with respect to the shoulder-type cylindrical plug having a protruding portion and the shoulder-type floating plug having a protruding portion, tests were carried out in order to examine the effects on the inner surface roughness of a tubing material, of the length $E_2$ of the horizontal part of the protruding portion provided on the plug, and of the coating provided on the plug.

The basic shape and dimensions of the plug and the die used are the same as those shown in FIGS. 7 and 8. The processing conditions were the same as those for the above-described test. $E_2$ was changed from 0.5 to 3.0 mm in both cases using the cylindrical plug and the floating plug, and Δh and $E_1$ were kept constant to 0.04 mm and 0.5 mm, respectively. The above conditions and the results are shown in FIG. 17.

As shown in FIG. 17, the length $E_2$ of the horizontal part of the protruding portion did not affect the inner surface roughness of the tubing material after subjected to drawing. However, when $E_2$ was 3.0 mm, seizure was caused in both cases. It can thus be proven that the desirable length $E_2$ of the horizontal part of the protruding portion is less than 3.0 mm.

Furthermore, a plug with a TiCN coating which has a low affinity for the tubing material, was applied in order to prevent seizure was subjected to the test. Seizure was not caused even under the conditions shown in FIGS. 14–17 under which seizure was caused on the plugs that were provided with no coating.

2. A case where a floating plug having a concaved portion is used

Also in the case of a floating plug having a concaved portion, the same mother tube, die and lubricating oil as those used in the above described cases of the shoulder-type plug having a protruding portion was used. The dimensions and shape of the plug used is shown in FIGS. 9(*a–b*).

The plug used was one made of a sintered hard alloy (equivalent to JIS V20), provided with a TiCN coating on the surface thereof, having a surface roughness expressed in Rmax of 0.3 micrometers.

Figure 9A:
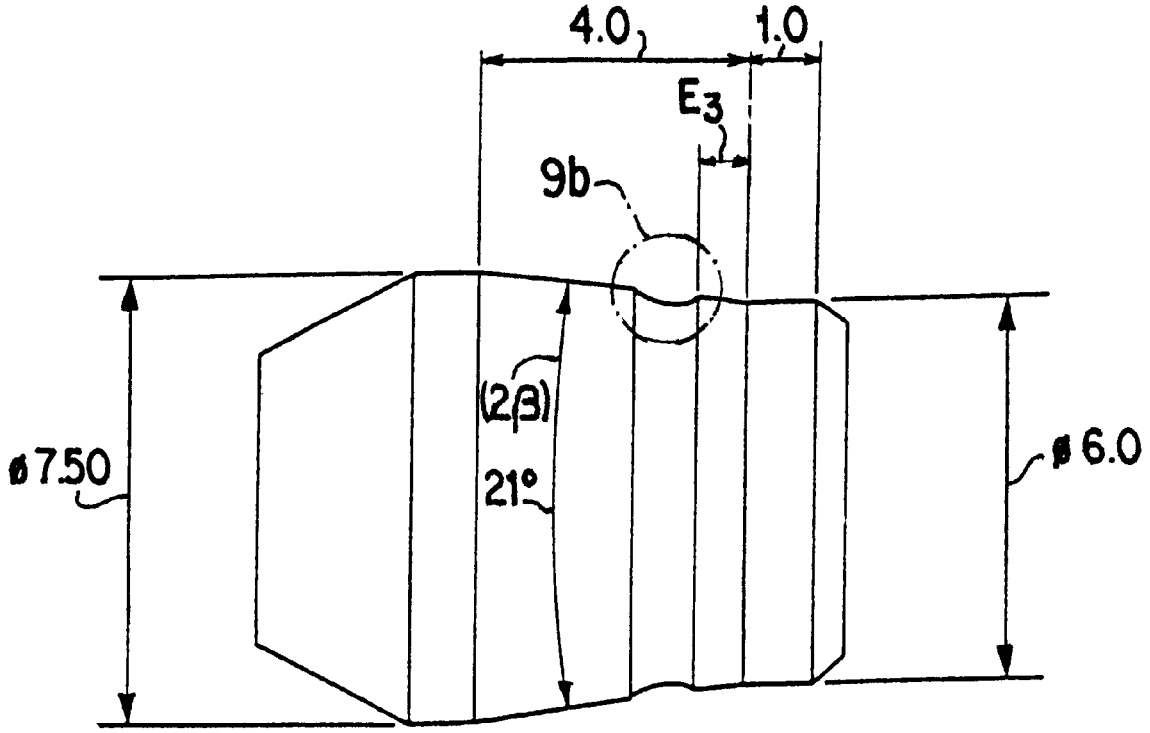
FIG. 9(*a*) is a general view, and FIG. 9(*b*) is an enlarged view of the part A (the concaved portion the wall-thickness-processing part).
Figure 9B:
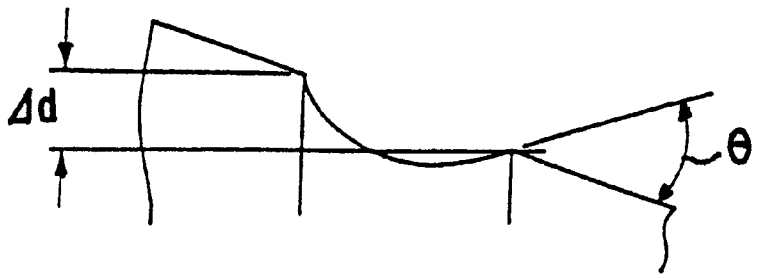
Figure 10A:
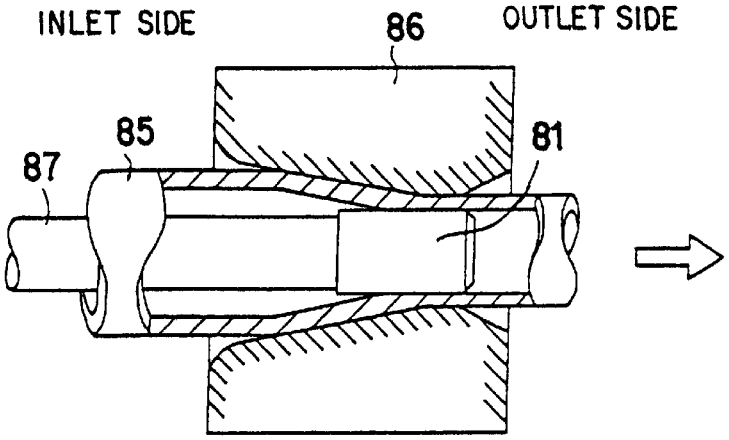
FIG. 10(*a*) is a side view, partly in cross section, and FIG. 10(*b*) is a longitudinal section which show the shape of a conventional plug, and a method of drawing, using the plug. In this figure, FIG. 10(*a*) shows a cylindrical plug, and FIG. 10(*b*) shows a floating plug. Further.
Figure 10B:
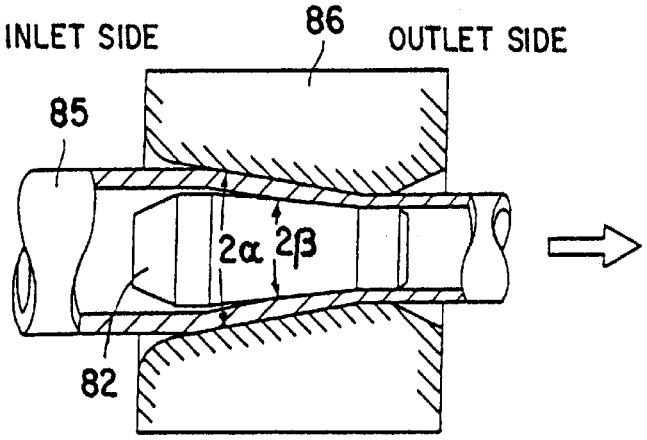
Figure 11:
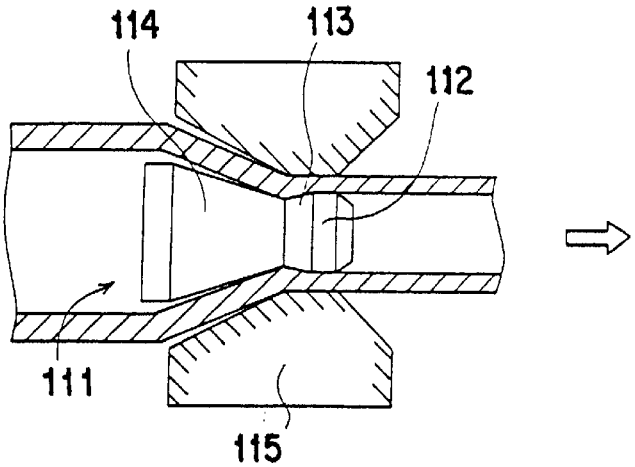
FIG. 11 is a longitudinal section explaining the shape of a floating plug used for conventional drawing of tubing material, and a method of drawing, using the floating plug. Furthermore, FIGS. 12(*a–c*) are a side view and longitudinal sections which show the shape of a conventional plug having a protruding portion, and a method of drawing, using the plug. In this figure, FIG. 12(*a*) and FIG. 12(*b*) show the process of drawing, and FIG. 12(*c*) is a side view of the plug.
Figure 12A:
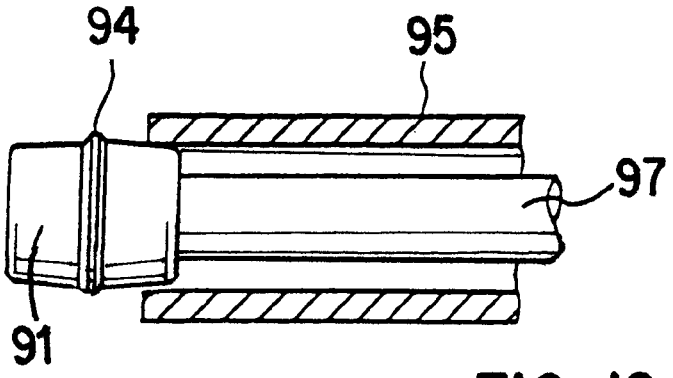
Figure 12B:
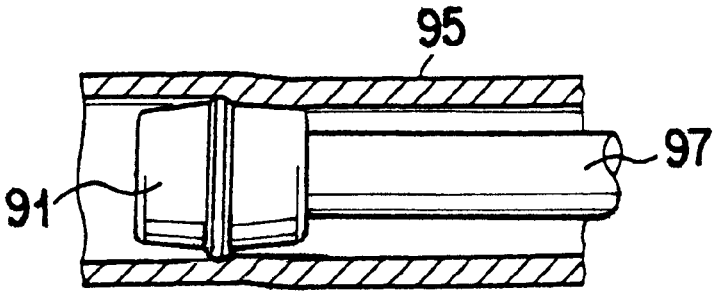
Figure 12C:
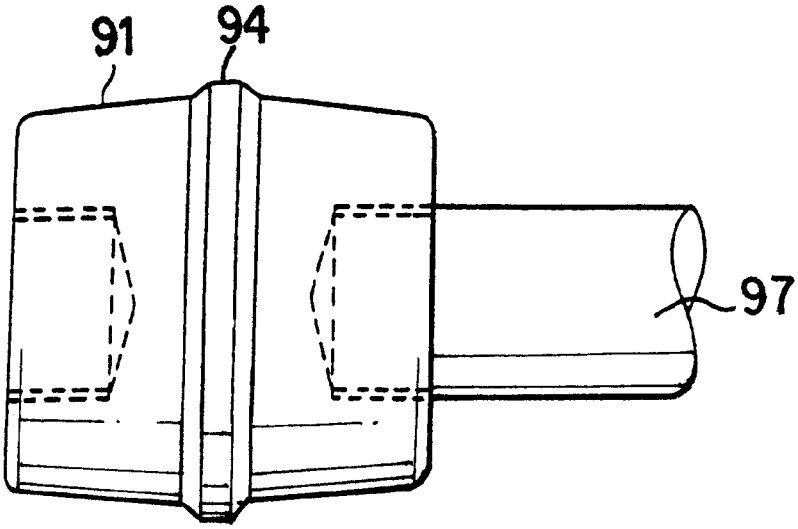
Figure 13:
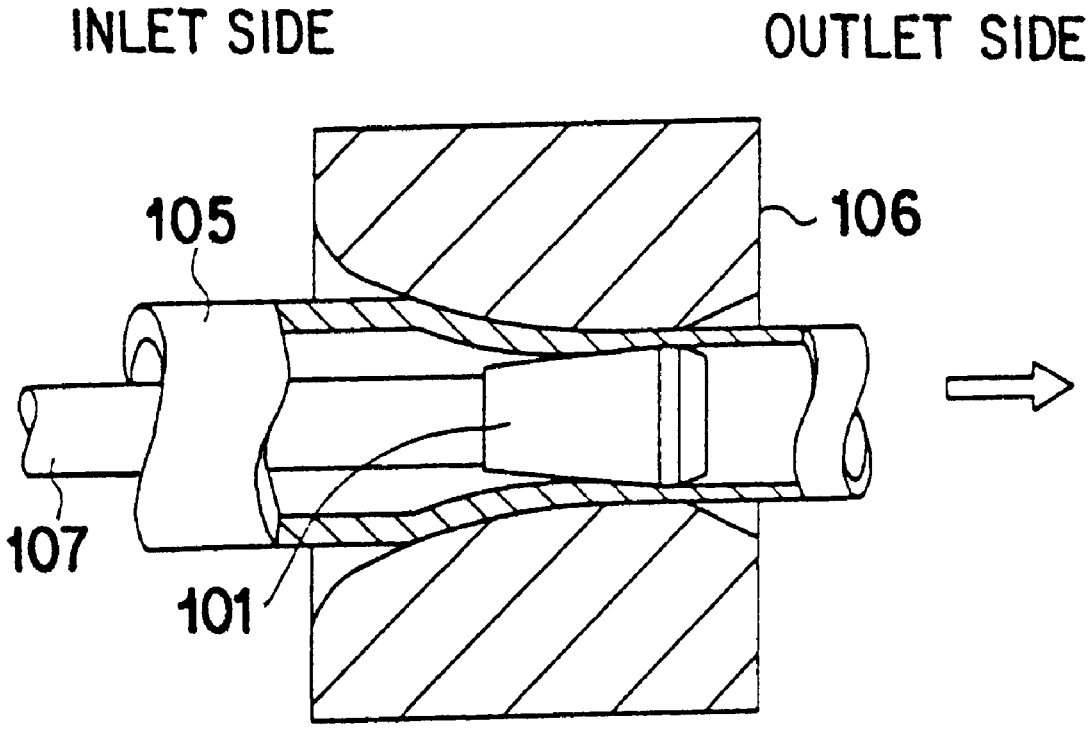
FIG. 13 is a side view, partly in cross section, and a longitudinal section which show the shape of a conventional plug used for increasing the inside diameter of a pipe, and a method of drawing, using the plug.

Cold drawing was conducted by changing the depth Δd of the concaved portion from 0 to 0.30 mm (from 0 to 0.05 mm when converted in to Δh, provided that $E_3$ shown in FIG. 9 was kept constant to 0.5 mm), or by changing E3 from 0 to 2.5 mm (provided that Δd was kept constant to 0.20 mm, which was 0.05 mm when converted into Δh), and Rmax was determined from the inner surface roughness. The results are shown in FIGS. 18 and 19. It is noted that the angle θ shown in FIG. 9(*b*) was kept constant to 10° in the process of drawing shown in FIGS. 18 and 19.

As shown in FIG. 18, the inner surface roughness can be obtained satisfactorily when Δd was 0.1 mm or more (0.01 mm or more when converted into Δh), and seizure was not caused. When compared with an ordinary plug having no concaved portion, the effect of improving the inner surface roughness can be obtained in the case where the plug having a concaved portion at a proper position thereon is used. When Δd is increased, the inner surface roughness of the tubing material tends to be lowered.

In this case, $C_L$ which is the length on the axial direction of the region of wall-thickness processing which is on the tapered part of the plug is 2.8 mm. Further, Δd is 0.20 mm and the angle β is 10.5°. Therefore, the distance $E_3$, where the position of the concaved portion is determined, is 1.72 mm when obtained from the previously-mentioned inequality (1).

As shown in FIG. 19, when $E_3$ exceeds 1.72 mm and becomes 2.0 mm or 2.5 mm, the inner surface roughness cannot be improved, and it is impossible to obtain an Rmax of 1.0 micrometer or less. When $E_3$ is 1.72 mm or less, the effect of improving the inner surface roughness is enhanced, and the inner surface roughness becomes lower as $E_3$ becomes small.

Subsequently, the effect of the angle θ shown in FIG. 9(*b*) was examined. Cold drawing was conducted under the processing conditions which were basically the same as those shown in FIGS. 18 and 19, provided that Δd and $E_3$ were kept constant to 0.15 mm and 0.5 mm, respectively, and the angle θ was changed from 0° to 60°. The test was determine whether seizure was caused or not caused, and the inner surface roughness was measured. The results are shown in FIG. 20.

As shown in FIG. 20, when θ was 0°, the shape of the plug was the same as that of an ordinary plug, and the wall-thickness processing proceeded slowly. Therefore, the inner surface roughness expressed in Rmax could not reach to 1.0 micrometer or less. When θ was 60°, the wall-thickness processing proceeded drastically, so that seizure was caused.

As described above, in the case where the shoulder-type plug having a protruding portion, and also in the case where the floating plug having a concaved portion, a lubricating oil (a mixed oil of sulfurized oil and chlorinated paraffin) was used for the lubrication of the mother pipe. In order to compare with this, cold drawing is conducted under the same conditions as those in the above, provided that chemical conversion treatment lubrication (ferrous oxalate film) which is usually employed in the drawing of a stainless steel pipe was used. However, the object which is to make the inner surface roughness of a tubing material, expressed in Rmax to 1.0 micrometer or less was not able to be attained. Therefore, in the practice of the method according to the present invention, chemical conversion treatment lubrication is not suitable.

The lowest limit of the inner surface roughness of a tubing material, expressed in Rmax is 0.3 micrometers in the above examples. This is because the the surface roughness of a plug, expressed in Rmax, at the current level of technology is limited to approximately 0.1 micrometers. In addition, the thickness of a lubricating oil film also affects the inner surface roughness of a tubing material. Therefore, if the surface roughness of a plug, expressed in Rmax can be made to 0.1 micrometers or less, the inner surface roughness of a pipe can also be made smaller than the above limit.

INDUSTRIAL APPLICABILITY

According to the present invention, a stainless steel pipe of the bright annealing finish type, having a highly-smoothed inner surface with an inner surface roughness expressed in Rmax of 1.0 micrometer or less, suitable for use in apparatus for the production of semiconductors, can be obtained by conducting cold drawing and bright annealing treatment only. By this method, such a treatment that has been considered to be essential, such as electrochemical polishing, can be omitted. The production cost can thus be greatly reduced. For this reason, the stainless steel pipe of the bright annealing finish type, having a highly-smoothed inner surface according to the present invention can be widely utilized in the fields of the production of semiconductors and the like.

What is claimed is:

1. A stainless steel pipe of the bright annealing finish type, having a highly-smoothed inner surface, characterized in that the inner surface roughness expressed in Rmax of the stainless steel is 1.0 micrometer or less, the inner surface roughness of 1.0 micrometer or less being achieved by cold plug drawing without subjecting the inner surface to electrochemical polishing after the cold plug drawing.

2. The stainless steel pipe of claim 1, wherein the inner surface roughness is obtained by subjecting the inner surface to shear plastic deformation concentrated on the inner surface and forming a work hardened layer on the inner surface.

3. The stainless steel pipe of claim 1, wherein the inner surface roughness is obtained by plug drawing during which the exterior of the pipe passes through a die and the interior of the pipe is work hardened by a plug, the surfaces of the die and plug which contact the pipe being coated with TiCN or the inner surface roughness is obtained by plug drawing during which a lubricating film of sulfurized oil and chlorinated paraffin is used.

4. The stainless steel pipe of claim 1, wherein the pipe has been subjected to bright annealing in a hydrogen furnace or vacuum heating furnace.

5. The stainless steel pipe of claim 1, wherein the inner surface roughness is 0.3 to 0.5 micrometers.

6. A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a cylindrical plug, it is subjected to bright annealing treatment to obtain a clean pipe, characterized in that the cold drawing is conducted by using a plug having a ring-like protruding portion provided on a part of the finishing part which is on the hinder part of the plug, with the slanting surface on the inlet side of the ring-like protruding portion kept within a bearing part of the die, followed by conducting bright annealing treatment.

7. The method of claim 6, wherein the plug is supported by a rod or the plug is a floating plug, the protruding portion of the plug being located within the die and plastically deforming the inner surface of the pipe by an amount in the direction of the wall thickness of the pipe of 0.01 to 0.08 mm.

8. The method of claim 6, wherein the surfaces of the die and plug which contact the pipe are coated with TiCN or a film of sulfurized oil and chlorinated paraffin is used as a lubricant on the die or plug.

9. The method of claim 6, wherein the bright annealing is carried out in a hydrogen furnace or a vacuum heating furnace.

10. A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a floating plug, it is subjected to bright annealing treatment to obtain a clean pipe, characterized in that the cold drawing is conducted by using a plug having a non-tapered part and a ring-like protruding portion continued thereto on a finishing part which is on the hinder part of the plug, with the slanting surface on the inlet side of the ring-like protruding portion kept within a bearing part of the die, followed by conducting bright annealing treatment.

11. The method of claim 10, wherein the protruding portion of the plug causes the inner surface of the pipe to undergo plastic deformation by an amount in the direction of the wall thickness of the pipe of 0.01 to 0.08 mm.

12. The method of claim 10, wherein the surfaces of the die and plug which contact the pipe are coated with TiCN or a lubricating film of sulfurized oil and chlorinated paraffin is used as a lubricant during the cold drawing.

13. The method of claim 10, wherein the bright annealing is carried out in a hydrogen furnace or a vacuum heating furnace.

14. A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a floating plug, it is subjected to bright annealing treatment to obtain a clean pipe, characterized in that the cold drawing is conducted by using a plug having a ring-like concaved portion provided on a wall-thickness-processing part which is the tapered part of the plug, followed by conducting bright annealing treatment.

15. The method of claim 14, wherein the concaved portion of the plug causes the inner surface of the pipe to undergo plastic deformation by an amount in the direction of the wall thickness of the pipe of 0.01 to 0.08 mm.

16. The method of claim 14, wherein the surfaces of the die and plug which contact the pipe are coated with TiCN or a lubricating film of sulfurized oil and chlorinated paraffin is used as a lubricant during the cold drawing.

17. A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a cylindrical plug, it is subjected to bright annealing treatment to obtain a clean pipe, characterized in that the cold drawing is conducted by using a plug having a ring-like protruding portion provided on a part of the finishing part which is on the hinder part of the plug, with the slanting surface on the inlet side of the ring-like protruding portion kept within a bearing part of the die, followed by conducting bright annealing treatment, the slanting surface forming an angle of 10 to 50° with the central axis of the plug.

18. A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a floating plug, it is subjected to bright annealing treatment to obtain a clean pipe, characterized in that the cold drawing is conducted by using a plug having a non-tapered part and a ring-like protruding portion continued thereto on a finishing part which is on the hinder part of the plug, with the slanting surface on the inlet side of the ring-like protruding portion kept within a bearing part of the die, followed by conducting bright annealing treatment, the slanting surface forming an angle of 10 to 50° with the central axis of the plug.

19. A method for producing a stainless steel pipe of the bright annealing finish type, having a highly-smoothed inner surface with an inner surface roughness expressed in Rmax of 1.0 micrometer or less, in which after a pipe is obtained by cold drawing, using a die and a floating plug, it is subjected to bright annealing treatment to obtain a clean pipe, characterized in that the cold drawing is conducted by using a plug having a ring-like concaved portion provided on a wall-thickness-processing part which is the tapered part of the plug, followed by conducting bright annealing treatment, the tapered part of the plug including a downstream portion located between the concaved portion and a non-tapered portion, the downstream portion of the tapered part of the plug having a length of 1.72 mm or less.

* * * * *